US007306484B1

(12) United States Patent
Mahoney et al.

(10) Patent No.: US 7,306,484 B1
(45) Date of Patent: Dec. 11, 2007

(54) COAX-TO-POWER ADAPTER

(75) Inventors: William G. Mahoney, Suwanee, GA (US); Vinitkumar S. Adi, Duluth, GA (US)

(73) Assignee: Scientific-Atlanta, Inc., Lawrenceville, GA (US)

( * ) Notice: Subject to any disclaimer, the term of this patent is extended or adjusted under 35 U.S.C. 154(b) by 0 days.

(21) Appl. No.: 11/426,445

(22) Filed: Jun. 26, 2006

(51) Int. Cl.
*H01R 9/05* (2006.01)

(52) U.S. Cl. ..... 439/578

(58) Field of Classification Search ..... 439/578, 439/63, 579–585
See application file for complete search history.

(56) References Cited

U.S. PATENT DOCUMENTS 3,443,150 A * 5/1969 Staats ..... 315/39.51
5,959,669 A * 9/1999 Mizoguchi et al. ..... 348/362
7,074,081 B2 * 7/2006 Hsia ..... 439/584
7,140,912 B2 * 11/2006 Khemakhem et al. ..... 439/578
7,144,273 B1 * 12/2006 Chawgo ..... 439/583

* cited by examiner

*Primary Examiner*—J. F. Duverne

(57) ABSTRACT

A dc-to-coax adapter is provided for establishing an electrical coupling between a power source and a coaxial cable device. The adapter may include a power connector portion and an RF connector portion. In an exemplary embodiment the power connector portion comprises a dc jack adapted to establish an electrical coupling with a standard dc barrel plug connector and the RF connector portion comprises a female F connector adapted for establishing electrical coupling with a male F connector. The contacts of the power connector portion may be integrated with the contacts of the RF connector portion the adapter housing may provide a continuous ground connection.

14 Claims, 3 Drawing Sheets

COAX-TO-POWER ADAPTER

TECHNICAL FIELD

The present invention relates to electrical connectors, and more particularly to an adapter for providing a power interface between a coaxial cable connector and a dc power connector.

BACKGROUND OF THE INVENTION

Coaxial cable is commonly used by the cable telecommunications industry to carry high frequency broadband signals. Coaxial cable or "coax" generally comprises a round central primary core conductor surrounded circumferentially by a dielectric insulating layer that is in turn surrounded by a cylindrical ground conductor braid that is surrounded by an additional dielectric insulating layer.

To ensure proper coax connections that minimize signal loss and provide impedance matching, the cable industry has developed standard coaxial cable connectors, commonly referred to as RF connectors that fit the inner conductor, dielectric, and jacket dimensions of coaxial cable. These RF connectors generally comprise a male connector part that is typically applied to a coaxial cable and a female connector part that is typically connected to a coax device or splice; the male and female connector parts being adapted for engagement with each other. Examples of standard RF connectors include F, BNC, and N connectors, to name a few. Adapters have also been developed for connecting one type of standard RF connector with another, such as for connecting an F connector and a BNC connector. Accordingly, cable telecommunications equipment is typically manufactured with RF connector compatible ports. For example, a typical set top box or cable-ready television found in a subscriber's home may be provided with a female F connector port so that it can be readily connected to a male F connector at the end of a coax drop cable.

Although coaxial cable is capable of carrying power in addition to RF signals, power is typically only provided to coaxial cable on the transmission side of a cable network and is not provided to the subscriber. In the past there has been little need to provide an interface between an RF connector and a standard dc power connector as most coaxial devices in the home that required power were provided either with a plug or a dc power jack. For example, a cable-ready television is typically provided with an RF connector port to receive RF signals via a coaxial drop cable and a plug that can be plugged directly into a wall outlet for power. Most cable modems are provided with an RF connector port for receiving signals from a coax drop cable and a dc jack that is adapted for connection with a barrel plug connector of a dc power adapter that is plugged into a wall outlet. With the development of new technology, however, it is becoming increasingly desirable to provide power to cable industry devices both at the transmission network and at a subscriber's home that are not provided with a dc jack or a plug but only with RF connector ports. For example, it may be desirable to provide power to a line extender in the network or to a drop amp in a subscriber's home that has RF connector ports. Drop amps have become particularly common as subscriber's increase the number of devices which receive the cable signals, thereby necessitating a boost in the RF signals.

But whereas the cable telecommunications industry made its devices compatible with RF connectors, power supplies are typically provided with connectors that are not compatible with RF connectors. For example, the typical dc power adapter that plugs into a standard wall outlet is provided with a barrel-type connector arrangement in which a male barrel plug is adapted for engagement with a female jack. Standard barrel connector sizes have been developed by various companies and standard setting bodies and these connectors are typically classified by the barrel diameter of the plug and the pin size of the female jack. Because of this incompatibility between RF connectors and dc power connectors it is often difficult and time consuming to provide a power connection to a coaxial device.

Presently, one method of providing power to an RF connector compatible device on the cable network is through the use of external leads that connect to pigtails of a power supply. For example, external leads are provided to a coax device and the dc barrel connector of a power adapter is replaced with pigtails. The leads are then soldered to the pigtails to provide an electrical connection between the coax device and the power adapter. Another method is through the use of an F connector provided with an external lead. The F connector is connected to an RF port of a coax device and the lead attached to the power circuit of a printed circuit board. These prior art arrangements have several drawbacks, however. First, the arrangements require the customization of the coax device and/or the power supply. In addition, these arrangements are difficult to install and the resulting connections have a large number of interfaces which increases the chance of breakdown and power loss. Furthermore, once connected these prior art arrangements are also not easily disconnected when desired. Finally, such arrangements raise various regulatory issues, particularly with regard to the power supply.

From the foregoing, it can be appreciated that it would be desirable to have a better approach for providing power to a coaxial device and more particularly, for providing an interface between a standard RF connector and a standard dc power connector.

BRIEF DESCRIPTION OF THE DRAWINGS

The preferred embodiments of the invention can be better understood with reference to the following drawings. The components in the drawings are not necessarily to scale, emphasis instead being placed upon clearly illustrating the principles of the invention. Moreover, in the drawings, like reference numerals designate corresponding parts through the several views.

DETAILED DESCRIPTION OF THE PREFERRED EMBODIMENTS

The preferred embodiments of the present invention are described in the context of an adapter interface for electrical connectors. More specifically, an adapter is provided for providing an interface between a coax connector and a dc power connector through a rigid adapter that provides ease of assembly and installation and a reliable and robust connection. The following describes structural aspects of various preferred embodiments of the invention.

Figure 1:
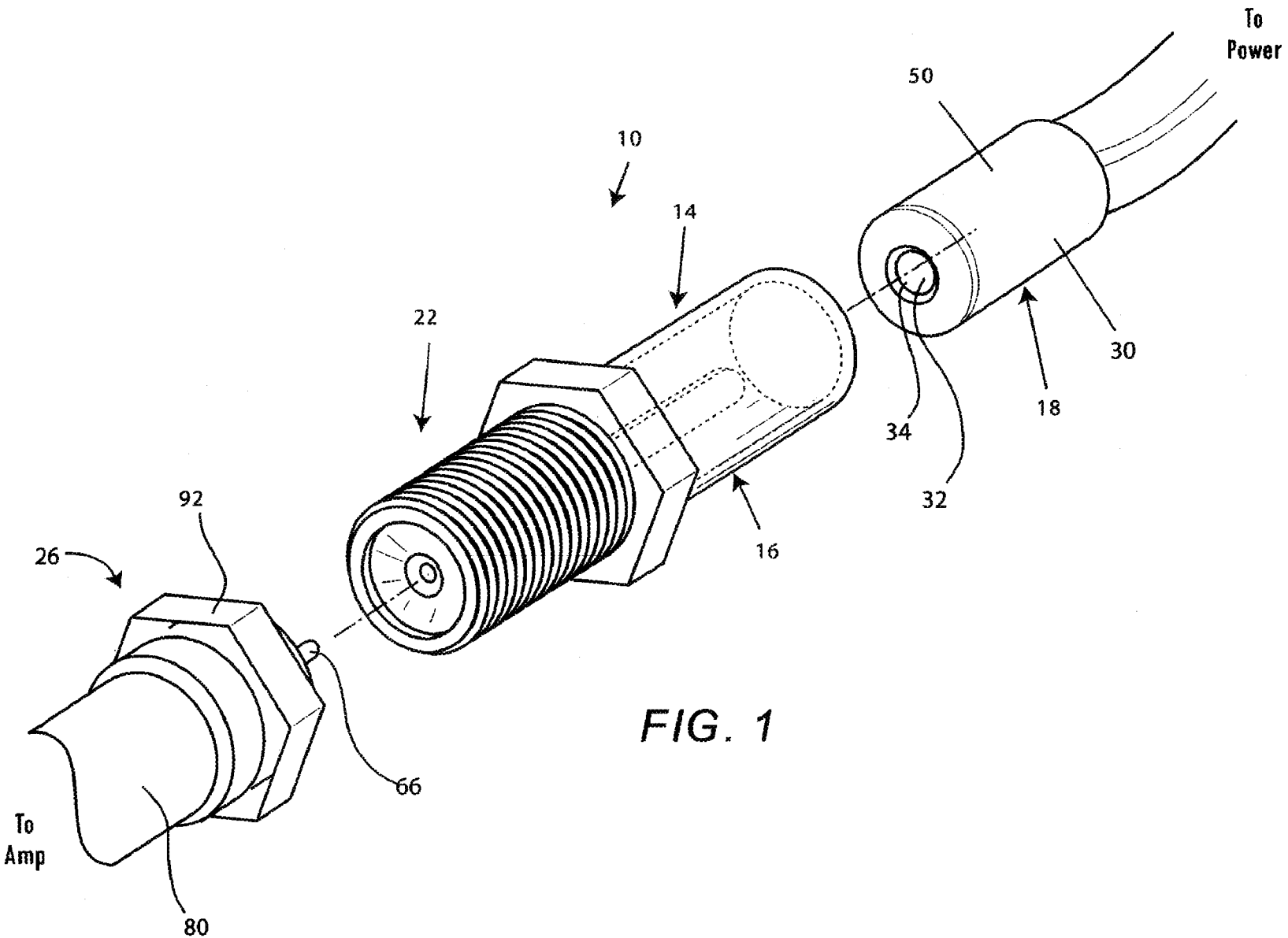
FIG. 1 is a front perspective view of an example of an electrical adapter in accordance with an exemplary embodiment of the invention.

Referring in more detail to the drawings, FIG. 1 shows a perspective view of one example of a coax-to-power adapter 10 constructed in accordance with one preferred embodiment of the present invention. The adapter includes an exterior that acts as a ground conductor and internal contacts that act as a primary conductor.

A first end of the adapter 10 is provided with a power connector portion 14 that is arranged and configured to form a mechanical and electrical connection with a dc power connector. In this exemplary embodiment the power connector portion 14 is in the form of a dc power jack 16 that is adapted for connecting with a standard dc barrel connector plug 18. The resulting connection between the dc jack 16 and the dc barrel connector plug 18 is a two-conductor connection including primary and ground connections. As will be described in more detail below, the adapter 10 may be provided with integral primary and ground conductors so that a power connection with a minimum number of interfaces may be achieved thereby reducing the number of potential failure points.

A second end of the adapter 10 is provided with a RF connector portion 22 that is adapted for electrically and mechanically connecting with a standard coaxial cable connector. As will be described in more detail below, the resulting adapter-to-coax connection is also a two-conductor connection that includes a primary conductor and a ground conductor. In the embodiment shown in FIG. 1, the RF connector portion 22 is configured as a standard female F connector and adapted for connecting with a standard male F connector 26. F connectors are commonly used in the 75-ohm broadband telecommunications industry for drop cables, such as those typically found in a cable subscriber's home.

As mentioned above, the adapter 10 is adapted for electrical and mechanical connection with a standard dc barrel connector. A typical dc barrel connector plug 18 includes a barrel-shaped housing 30 having a bore 32 with a contact lining that defines a primary tip conductor 34. The tip conductor 34 is adapted for electrical connection with the pin conductor of a dc jack. An outer ground conductor is on the outer surface of the barrel housing 30 and is commonly referred to as a barrel conductor 50. In this case, the dc power plug 18 is shown as a conventional dc barrel plug that may be attached to a power supply, such as a dc adapter that may be plugged into a standard ac outlet to provide direct current to the barrel connector plug 18.

Figure 2A:
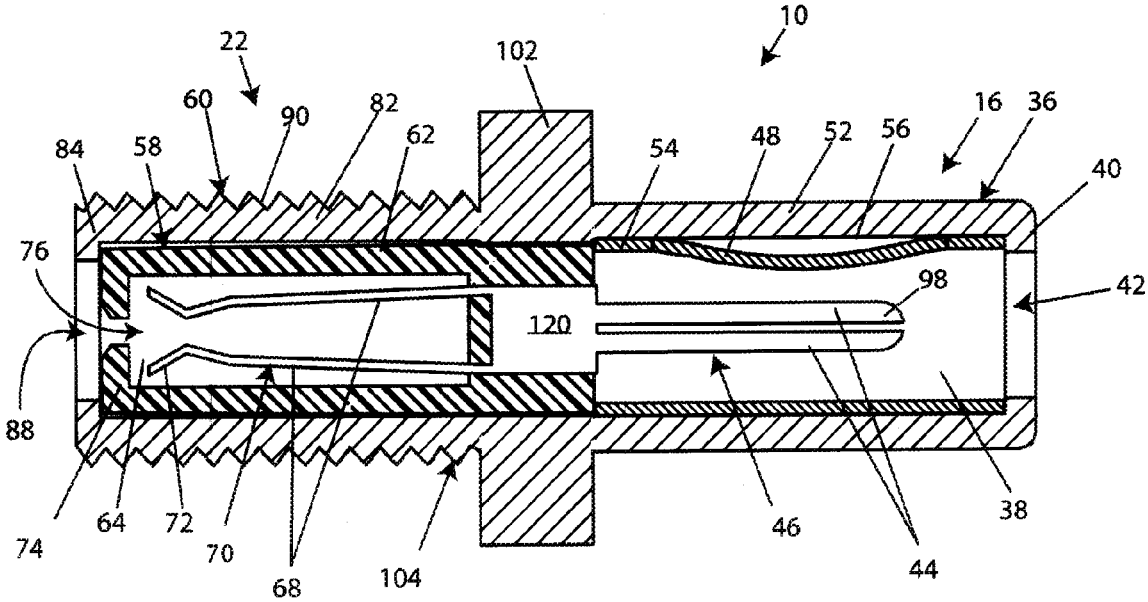
FIG. 2A is a cross-sectional view along line 1A-1A of the exemplary adapter shown in FIG. 1.

The power connector portion 14 of the exemplary adapter 10 of FIG. 1 is in the form of a dc power jack 16 that is adapted for electrical connection with the standard dc barrel plug 18. As seen in FIG. 2A, the power jack 16 comprises a barrel-type housing 36 having a bore 38 that is adapted to receive the dc barrel connector 18. The jack housing 36 includes a sidewall 52 and a flange 40 extending over an open end of the bore 38 to define a plug receiving opening 42. Two parallel spaced-apart electroconductive pin contacts 44 extend within the bore 38 and define a pin conductor 46. The pin contacts 44 are adapted for electrical connection with the tip conductor 34 of the dc barrel plug 18.

Figure 3:
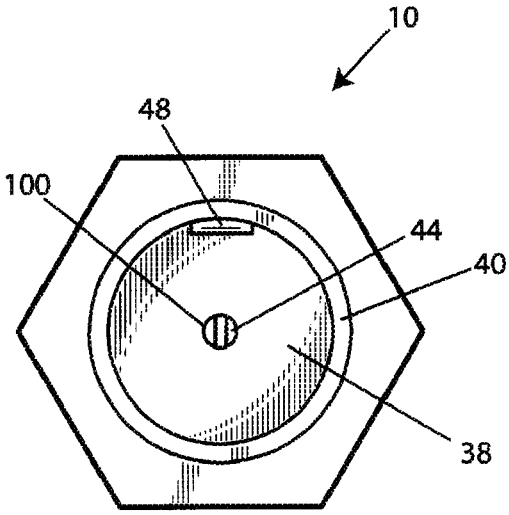
FIG. 3 is a right side view of the exemplary adapter shown in FIG. 2.

In this exemplary embodiment of the adapter 10 pin conductor 46, the jack housing 36, and the jack bore 38 are adapted to receive a standard concentric barrel plug having an outside diameter of about 5.5 mm and a length of about 9.5 mm. The jack 16 has a pin conductor 46 diameter of about 2.1 mm for fitting the bore 32 of the dc barrel plug 18 so as to make electrical contact between the pin contacts 44 and the tip conductor 34. Of course other pin, bore, and barrel sizes may be used so that the adapter 10 could connect with other sized plug connectors. The pin contacts 44 may have curved tips 98 to assist in guiding the contacts 44 within the bore 32 of the dc barrel connector plug 18. As best seen in FIG. 3, the pin contacts 44 are semi-circular in cross section so that their curved outer surface 100 conforms to the curved surface of tip conductor 34.

In addition to a primary conductor, the dc jack 16 is also provided with a ground conductor adapted for making a ground connection with a dc barrel connector pug 18. An electroconductive ground contact 48 is provided within the bore 38 of the dc jack 16 and is adapted for making a ground connection with the barrel conductor 50 of the dc barrel connector plug 18. The ground contact 48 is shown in the form of a leaf spring that bows into the bore 38 of the dc jack 16. The ground contact 48 may be attached to an electroconductive cylindrical sleeve 54 attached to the inner surface 56 of the of the dc jack sidewall 52. The ground contact 48 and the sleeve 54 are thus in electrical contact with the electroconductive jack housing 36. When the dc barrel connector plug 18 is inserted into the jack bore 38 the ground conductor 50 of the dc barrel connector plug 18 makes electrical connection with the ground contact 48. A continuous electrical ground connection is thus established between the barrel tip conductor 34, the ground contact 48, the sleeve 54, and the jack housing 36. Thus, when power is provided to the dc barrel connector plug 18 a ground current may be sent from the barrel tip conductor 34 to the ground contact 48. As discussed in more detail below this continuous ground connection of the dc jack portion 16 makes electrical connection with a continuous ground of the RF connector portion 22 so that a continuous ground extends through the length of the adapter 10.

Figure 2B:
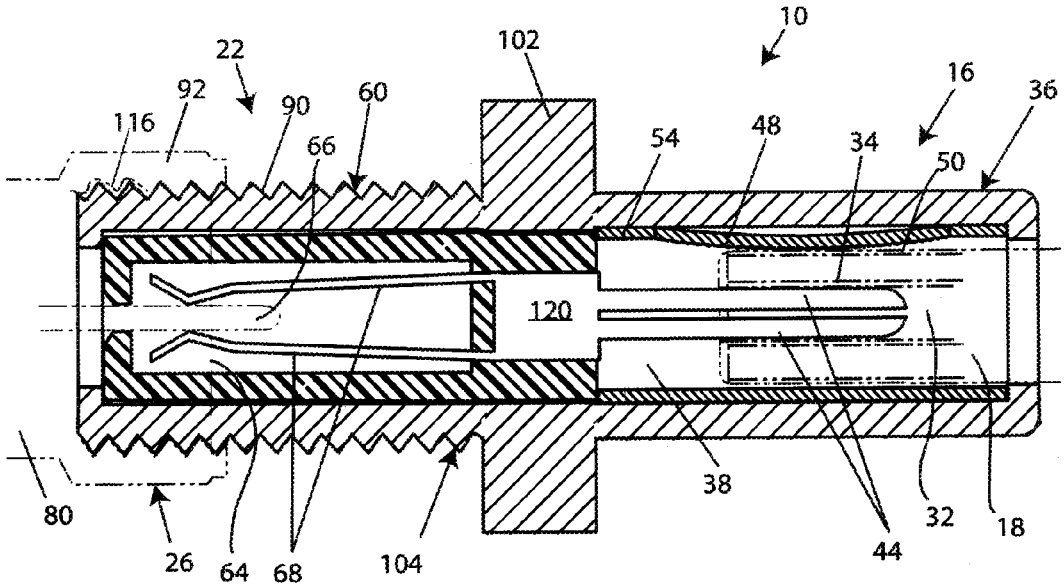
FIG. 2B shows the adapter of FIG. 2A coupled to a dc barrel connector plug and an RF connector.

The ground contact 48 may be formed as a partial cutout portion of the sleeve 54. The area behind the bowed portion serves as a recess space for the ground contact 48 when it bends due to the insertion of the barrel plug connector 18 (FIG. 2B). By having the ground contact 48 in the form of a bowed leaf spring it is provided with some resilience so that when it is compressed from its bowed position it maintains good electrical contact with the barrel conductor 50. The sleeve 54 may be attached to the inner surface 56 of the jack housing 36 to allow the sleeve 54 to rotate within the housing while maintaining electrical contact with the housing 36.

As mentioned above, the adapter 10 also includes an RF connector portion 22 adapted for making primary and ground connections with a standard RF connector. In the exemplary embodiment shown in cross-section in FIGS. 2A-2B, the RF connector portion 22 is in the form of and comports with the physical dimensions of a standard female F connector that is adapted to mate with a standard male F connector 26. F connectors are commonly used in the 75-ohm broadband telecommunications industry and the Society of Cable Telecommunications Engineers (SCTE) has developed standards for the physical and performance characteristics of F Connectors that may be found at www.scte.org. The SCTE standards for female F connectors ANSI/SCTE01 2006 (outdoor) and ANSI/SCTE02 2006 (indoor) are both hereby incorporated by reference herein.

The RF connector portion 22 includes concentric inner 58 and outer 60 hollow cylindrical-type housings. The inner housing 58 includes a sidewall 62 that defines a bore 64 adapted to receive the center conductor 66 of the male F connector 26. Extending through the interior of the inner housing 58 is a pair of parallel-spaced apart electrically conductive contact members 68 that define a conductor 70 for establishing an electrical connection with the center conductor 66. The contact members 68 may be provided with angled projecting tips 72 to enhance their guiding of the center conductor 66. The inner housing 58 may be made of dielectric material, such as Teflon® or TPX® commonly used in F connectors for shielding RF signals. In exemplary embodiments discussed herein in which power but no RF signals are sent through the adapter 10, non-dielectric material may be used such as ABS.

A flange 74 extends partially over an open end of the inner housing 58 to define a circular inner receiving guide 76 adapted to receive the center conductor 66 therethrough. The flange 74 may have a beveled edge 78 to assist in guiding the center conductor 66 within the receiving guide 76. In this exemplary embodiment the inner receiving guide 76 has a diameter of about 1.2 mm. As shown in FIG. 2A the contact members 68 are arranged to engage the center conductor 66 as it extends through the receiving guide 76 and may be resilient so that when pushed outwardly by the center conductor 66 the contact members 68 maintain positive contact with the center conductor 66. The contact between the center conductor 66 and the contact members 68 allows for primary (positive) current to be sent from the adapter 10 to the male F connector 26. The male F connector 26 may be attached to a first end of a coaxial cable 80 the other end of which is connected to a coaxial device, such as a drop amp, using another RF connector. Power provided from the adapter 10 may thus be provided to a coaxial device via the coaxial cable 80.

In addition to establishing a primary electrical contact with an RF connector, the RF connector portion 22 is also adapted to establish an electrical ground connection with an RF connector. An outer cylindrical-shaped housing 60 is provided concentrically around the inner housing 58. The outer housing 60 is electroconductive and serves as a ground conductor adapted to make a ground connection with the male F connector 26. As will be discussed in more detail below, the outer housing 60 may also form part of a continuous ground conductor of the adapter 10. The outer housing 60 includes a sidewall 82 and a flange 84 that extends partially over the flange 74 of the inner housing 58 and defines a reference plane opening 88. In this exemplary embodiment, the reference plane opening is about 5.5 mm. The outer housing 60 is provided with external threads 90 for engaging the internal threads of a nut 92 (FIG. 1) of the male F connector 26.

The engagement of the nut 92 with the threads 90 of the outer housing 60 provides a ground connection between the housing 60 and the nut 92 and thus between the adapter 10 and the male F connector 26. The outer housing 60 may also have a beveled edge (not shown) to assist with the engagement of the male F connector 26.

Figure 4:
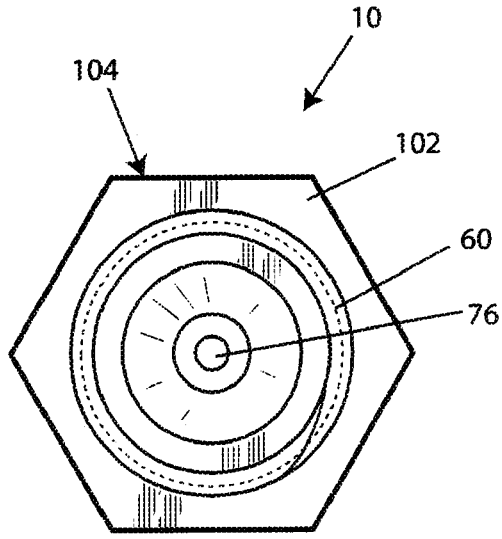
FIG. 4 is a left side view of the exemplary adapter shown in FIG. 3.

The RF connector portion 22 is also provided with a nut 102. The nut 102 is electroconductive and has a hexagonal cross section (FIG. 4) so that it may be readily engaged with a wrench or other tool so that the adapter may be rotated. The nut 102 may also act as a bulkhead of the adapter 10 and as a stop when receiving the male F connector 14 in the RF connector portion 22 or when receiving a barrel connector plug 18 in the dc jack portion 16. The nut 102 is located between and in electrical contact with both the outer housing 60 of the RF connector portion 22 and the housing 36 of the dc jack 16 so that the adapter housing 104 acts as a continuous ground conductor.

When the dc barrel plug connector 18 is inserted into the dc jack bore 38, the barrel conductor 50 of the dc plug connector 18 is in electrical contact with the sidewall 52 of the dc jack 16 through the ground contact 48 and sleeve 54, so that the housing 36 acts as a ground conductor. As mentioned above, the dc jack portion 16 and the RF connector portion 22 are in electrical contact with each other so that the outer adapter housing 104 defines a continuous integral ground conductor. When the male F connector 26 is connected to the RF connector portion 22 of the adapter 10 the ground braid 116 in the coaxial cable 80 makes electrical contact with the outer housing 60 (FIG. 2B) of the RF connector portion 22. An electrical ground connection is thus established between the adapter 10 and the coaxial cable 80.

In addition to providing a continuous integral ground conductor 104 as described above, the adapter 10 may also provide a continuous integral primary conductor 120. For example, the conductor 70 of the RF connector portion 22 (formed by the contact members 68) may be integrated with the pin conductor 46 of the dc jack 16 (formed by the pin contacts 44) to define a single integral primary conductor 120. That is, the RF connector portion conductor 70 and the pin conductor 46 may be made of a continuous conductive material. This eliminates the need for providing an interface between the conductors of the RF connector portion 22 and the dc jack portion 16 as the conductors are one in the same. Thus, when the dc barrel connector plug 18 is inserted into the dc jack 16 of the adapter 10 the pin contacts 44 make electrical contact with the tip conductor 34 of the barrel connector plug 18 so that current runs through the pin contacts 44 of the dc jack plug 16 into the contact members 68 of the RF connector portion 22 and to the core conductor 66 of the male F connector 26.

It is therefore seen that with the present invention, a standard dc adapter having a standard barrel connector can be used to power a coax device. A user may simply connect the dc jack 16 of the adapter 10 to the barrel plug 18 of a power supply and attach the RF connector portion 22 to an RF connector of a coaxial cable 80 connected to the coax device. The adapter 10 may also be used in conjunction with other readily available adapters to provide a power-to-coax interface. For example, in the case where a coax device employs a BNC compatible port and the adapter 10 is provided with an F connector, a user may connect the dc jack 16 of the adapter 10 to a barrel connector 18 of a dc adapter and connect a BNC-to-F connector to the RF connector portion 22 of the adapter 10. The user may then connect the BNC port of the BNC-to-F connector to the BNC connector of a coaxial cable that may then be connected to the coax device. The present invention thus provides a method for easily providing power to a coax device without the need of pigtails or soldering wires, or using a circuit board.

FIG. 2B shows a cross sectional view in which the dc barrel connector plug 18 (shown in phantom) is connected to the dc jack 16 of the adapter 10 and a male F connector 26 (shown in phantom) is connected to the RF connector portion 22 of the adapter 10. The barrel connector plug 18 is received in the dc jack bore 38 so that the barrel conductor 50 makes an electrical connection with the ground contact 48, as discussed above, so that a ground connection is made between the barrel conductor 50, the ground contact 48, the sleeve 54, and the housing 36 of the dc jack 16. The nut 102 and outer housing 60 of the RF connector portion 22 are electroconductive and in electrical contact with the dc jack housing 36 so that the adapter housing 104 acts as a continuous integral ground conductor. In this case, the threaded nut 92 of the male F connector 26 engages the outer threads 90 of the RF connector portion 22. The male F connector 26 is typically crimped or screwed on the ground conductor braid 116 of the coaxial cable 80 so that the ground conductor braid 116 of the coaxial cable 80 contacts the outer threads 90 of the outer housing 60 to establish a ground connection. Thus, an electrical ground connection is established through the dc barrel plug 18, the adapter 10, and the coaxial cable 80.

To establish a primary conductor connection the pin contacts 44 extend into the bore 32 of the dc barrel connector plug 18 and make electrical contact with the tip conductor 34. The male F connector center conductor 66 extends within the receiving guide 76 and makes electrical contact with the contact members 68 of the RF connector portion 22. Because the contact members 68 of the RF connector portion 22 are integral with the pin contacts 44 of the dc jack portion 16, which together define a primary conductor 120 of the adapter 10 as discussed above, current runs from the pin contacts 44 to the contacts members 68 and into the center conductor 66 of the coaxial cable 80 to which it is attached. The coaxial cable, 80 may then be connected with any variety of coax devices adapted to connect to coaxial cable and thus power the coax device.

Figure 5:
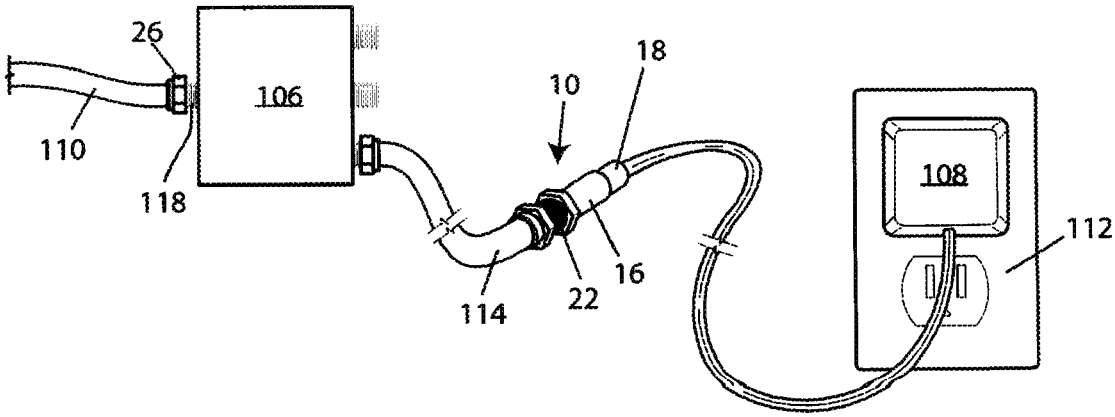
FIG. 5 shows an adapter used in conjunction with a dc power supply and a drop amp in accordance with an exemplary embodiment of the invention.

An exemplary method of employing the invention will now be described in the context of a cable drop amp. Drop amps are typically provided with female F connector ports for establishing both power and RF connections. As shown in FIG. 5, to provide RF signals to a drop amp 106 a user may connect an F connector 26 of a coaxial drop cable 110. To provide power to the drop amp 106 a user can simply plug a standard dc adapter 108 into a standard wall outlet 112 and connect the adapter's barrel connector plug 18 to the dc jack portion 16 of the adapter 10. The adapter 10 makes both primary and ground electrical connections with the barrel connector plug 16 as discussed above. The user may then connect a second coaxial drop cable 114 to the RF connector portion 22 of the adapter 10. In this case, a male F connector 26 at the end of the coaxial cable 114 is connected to the RF connector portion 22 of the adapter 10 as discussed above. The other end of the coaxial cable 114 may then be connected to the RF connector port 118 on the drop amp 106. DC current is thus provided from the dc adapter 108 to the dc-to-coax adapter 10, from the dc-to-coax adapter 10 to the coaxial cable 114, and from the coaxial cable 114 to the drop amp 106. This arrangement allows cable equipment manufacturers to produce cable devices without the need of a separate power connector port. It also obviates the necessity of providing a power adapter or the drop amp with leads thereby easing installation.

In light of the foregoing disclosure of the invention and description of certain preferred embodiments, those who are skilled in this area of technology will readily understand that various modifications and adaptations can be made without departing from the true scope and spirit of the invention. For example, for purposes of clarity and not limitation the exemplary embodiments were discussed in the context in which the RF connector portion 22 was in the form of an F connector. It is contemplated however that the RF connector portion 22 could take the form of other standard RF connectors such as a BNC, N, or SMA connector. Likewise, the power connector portion 16 in the form of a dc power jack may be sized to fit a variety of standard power connector. All such modifications and adaptations are intended to be covered by the following claims.

The invention claimed is:

1. A coax-to-power adapter, comprising:

a housing having a first end and a second end;

an RF connector portion at said first end for electrical coupling with an RF connector;

a power connector portion at said second end for electrical coupling with a dc power connector;

an integral dc primary conductor for establishing a continuous dc current path between said power connector portion and said RF connector portion, said integral primary conductor having a first dc contact at said dc connector portion for establishing a dc electrical connection with a dc conductor of said dc power connector and a second dc contact at said RF connector portion for establishing a dc electrical connection with a center conductor of the RF connector;

a first ground contact at said dc power connector portion for contacting a ground conductor of said dc power connector; and a second ground contact at said RF connector portion for contacting a ground conductor of said RF connector, wherein said first ground contact and said second ground contact are electrically connected to said housing to establish a continuous ground connection over said housing between said dc connector and said RF connector.

2. The coax-to-power adapter of claim 1, wherein said first dc contact means comprises at least one pin contact for engaging the dc conductor of a dc barrel connector.

3. The coax-to-power adapter of claim 1, wherein said RF connector portion comprises an F connector.

4. The coax-to-power adapter of claim 1, wherein said RF connector portion comprises a BNC connector.

5. The coax-to-power adapter of claim 1, wherein said RF connector portion comprises an N connector.

6. The coax-to-power adapter of claim 1, wherein said first ground contact comprises a conductive sleeve electrically coupled to said housing.

7. The coax-to-power adapter of claim 1, wherein said second ground contact means comprises an outer portion of said housing.

8. The coax-to-power adapter of claim 6, wherein said first ground contact further comprises a conductive leaf spring electrically coupled to said sleeve.

9. A coax-to-power adapter, comprising:

an F connector;

a dc jack integrated with said F connector; and an integral primary conductor extending between said F connector and said dc jack, said integral primary conductor having first dc contact means at said dc jack to establish a dc connection with a dc connector and second dc contact means at said F connector to establish dc contact with a center conductor of a male F connector to thereby provide a dc current connection between said dc connector and said center conductor.

10. The coax-to-power adapter of claim 9, wherein a housing of said F connector is electrically coupled to a housing of said dc jack to form a continuous ground connection.

11. A connector assembly for providing power to a coax device, comprising:

a coax-to-power adapter having an RF connector portion, said RF connector portion having first ground contact means for electrical coupling with a ground conductor of an RF connector and a dc power connector portion for electrical coupling with a ground conductor of a dc power connector;

a dc connector plug electrically coupled to said dc power connector portion; and an integral primary conductor extending between said RF connector portion and said dc power connector portion to thereby provide dc current from a dc conductor of said dc power connector to a center conductor of said RF connector.

12. The connector assembly of claim 11, further comprising an RF connector electrically coupled to said RF connector portion.

13. The connector assembly of claim 11 wherein said RF connector portion comprises an F connector and said dc power connector portion comprises a dc jack.

14. The connector assembly of claim 13, wherein said RF connector comprises a male F connector and said dc power connector comprises a dc barrel plug.

* * * * *